US012161931B1

(12) United States Patent
Labeda

(10) Patent No.: US 12,161,931 B1
(45) Date of Patent: Dec. 10, 2024

(54) WHEEL ASSEMBLY APPARATUS

(71) Applicant: Precision Sports, Inc., Lake Elsinore, CA (US)

(72) Inventor: Kevin Labeda, Canyon Lake, CA (US)

(73) Assignee: Precision Sports, Inc., Lake Elsinore, CA (US)

( * ) Notice: Subject to any disclaimer, the term of this patent is extended or adjusted under 35 U.S.C. 154(b) by 0 days.

(21) Appl. No.: 18/443,828

(22) Filed: Feb. 16, 2024

Related U.S. Application Data

(60) Provisional application No. 63/469,018, filed on May 25, 2023.

(51) Int. Cl.
*A63C 17/22* (2006.01)

(52) U.S. Cl.
CPC ..... *A63C 17/226* (2013.01); *A63C 17/223* (2013.01)

(58) Field of Classification Search
CPC ..... A63C 17/223; A63C 17/226
See application file for complete search history.

(56) References Cited

U.S. PATENT DOCUMENTS 4,128,254 A * 12/1978 Powell ..... A63C 17/01 301/64.707
4,531,785 A * 7/1985 Perkins ..... A63C 17/223 384/537
4,898,403 A * 2/1990 Johnson ..... A63C 17/223 280/11.205
5,028,058 A * 7/1991 Olson ..... A63C 17/226 280/11.232
5,573,309 A * 11/1996 Bekessy ..... A63C 17/223 301/5.303
5,601,342 A * 2/1997 Perner ..... A63C 17/226 301/124.2
5,884,923 A * 3/1999 Pratt ..... A63C 17/226 280/11.221
5,964,537 A * 10/1999 Hill, Jr. ..... B23P 17/00 29/280
6,105,976 A * 8/2000 Cottle ..... A63C 17/1436 280/11.19
7,125,024 B1 * 10/2006 Kelly ..... A63C 17/226 280/11.27
9,149,713 B2 * 10/2015 Bonten ..... A63C 17/226
10,398,964 B2 * 9/2019 Long ..... A63C 17/017
2005/0082774 A1 * 4/2005 Chiu ..... A63C 17/223 280/11.203

(Continued)

*Primary Examiner* — Jason R Bellinger
(74) *Attorney, Agent, or Firm* — Master Key IP, LLP; Justin G. Sanders

(57) ABSTRACT

A wheel assembly apparatus is disclosed. In at least one embodiment, a wheel hub is coaxially positionable within a wheel. A first bearing and a laterally opposed second bearing are each positionable coaxially within the wheel hub, with an inwardly facing medial surface of the first bearing being laterally spaced apart from an opposing inwardly facing medial surface of the second bearing so as to form a bearing gap therebetween. A first outer spacer is positionable in contact with an outwardly facing lateral surface of the first bearing, and a second outer spacer is positionable in contact with an outwardly facing lateral surface of the second bearing. Accordingly, an axle is capable of extending coaxially through each of the first outer spacer, first bearing, second bearing, second outer spacer, wheel hub and wheel, thereby enabling the wheel to rotate about the axle.

19 Claims, 7 Drawing Sheets

(56) References Cited

U.S. PATENT DOCUMENTS

| | | | | |
|---|---|---|---|---|
| 2006/0108857 | A1* | 5/2006 | Simon, Sr. | A63C 17/226<br>301/5.301 |
| 2011/0095598 | A1* | 4/2011 | Hooven | A63C 17/226<br>301/108.5 |
| 2013/0009448 | A1* | 1/2013 | Feroussier | A63C 17/226<br>301/5.305 |
| 2017/0361204 | A1* | 12/2017 | Bartlett | F16C 33/20 |

* cited by examiner

WHEEL ASSEMBLY APPARATUS

RELATED APPLICATIONS

This application claims priority and is entitled to the filing date of U.S. provisional application Ser. No. 63/469,018, filed on May 25, 2023. The contents of the aforementioned application are incorporated herein by reference.

BACKGROUND

The subject of this patent application relates generally to wheels, and more particularly to an improved wheel assembly apparatus.

Applicant hereby incorporates herein by reference any and all patents and published patent applications cited or referred to in this application.

By way of background, wheels 20 such as those used for inline skates traditionally provide a pair of laterally opposed bearings 22 configured for being positioned within openings molded into each side of a hub 24 of the wheel 20, as illustrated in FIGS. 1 and 2. The hub 24 also provides a central spacer 26 positioned between the bearings 22 (either machined into an axle 28 or configured for sliding over the axle 28, depending on the axle system used) so as to contact an inwardly facing medial surface of each of the bearings 22 and hold the bearings 22 a correct distance apart from one another.

Inline skate wheels are typically constructed out of polyurethane, as most other plastic and rubber materials either wear down too quickly or have too much rolling resistance. Additionally, traditional inline skate wheels have a Shore hardness that typically ranges between 72 A-93 A. Harder wheels tend to be more durable, while softer wheels tend to be more flexible, have better grip and accelerate more straightforwardly when striding. When inline skates are used for activities such as roller hockey, acceleration is critical but is often sacrificed in the interest of prolonging the life of the wheels, which means that harder wheels are typically chosen over softer wheels.

Thus, there remains a need for a wheel assembly that is durable without sacrificing performance. Aspects of the present invention fulfill these needs and provide further related advantages as described in the following summary.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a wheel assembly apparatus. In at least one embodiment, a wheel hub is coaxially positionable within a wheel. A first bearing and a laterally opposed second bearing are each positionable coaxially within the wheel hub, with an inwardly facing medial surface of the first bearing being laterally spaced apart from an opposing inwardly facing medial surface of the second bearing so as to form a bearing gap therebetween. A first outer spacer is positionable in contact with an outwardly facing lateral surface of the first bearing, and a second outer spacer is positionable in contact with an outwardly facing lateral surface of the second bearing. Accordingly, an axle is capable of extending coaxially through each of the first outer spacer, first bearing, second bearing, second outer spacer, wheel hub and wheel, thereby enabling the wheel to rotate about the axle.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
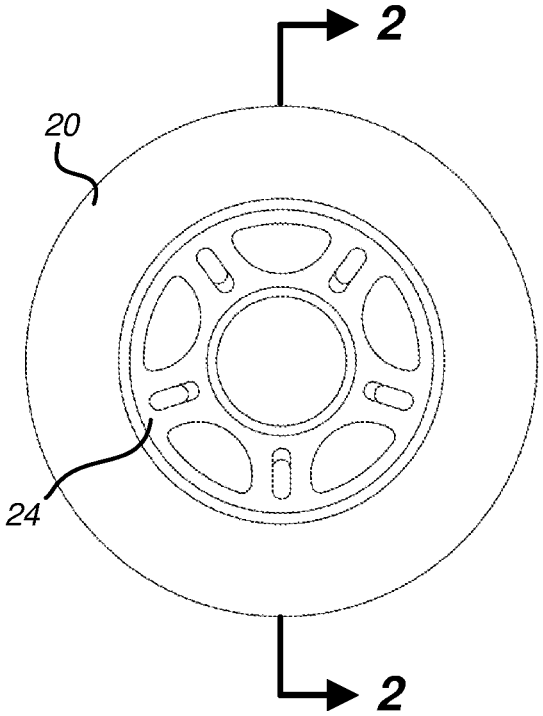
Fig. 1 (prior art)
FIG. 1 is a side elevational view of an exemplary prior art wheel assembly.
Figure 2:
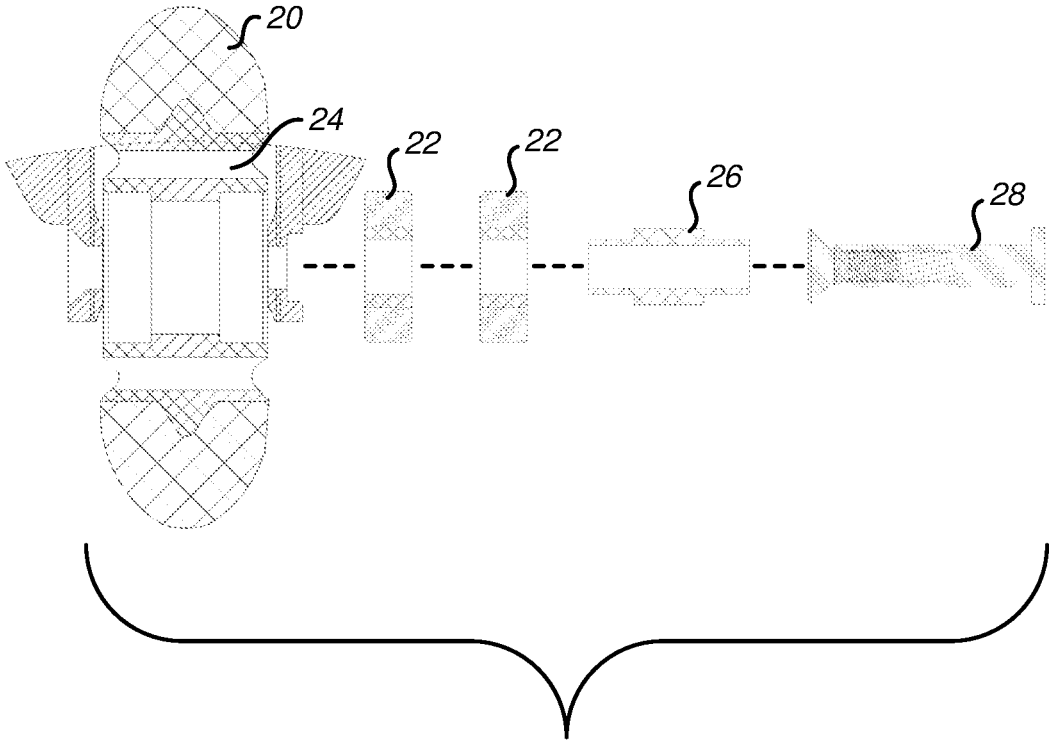
Fig. 2 (prior art)
FIG. 2 is an exploded cross-sectional view taken along line 2-2 of FIG. 1.
Figure 3:
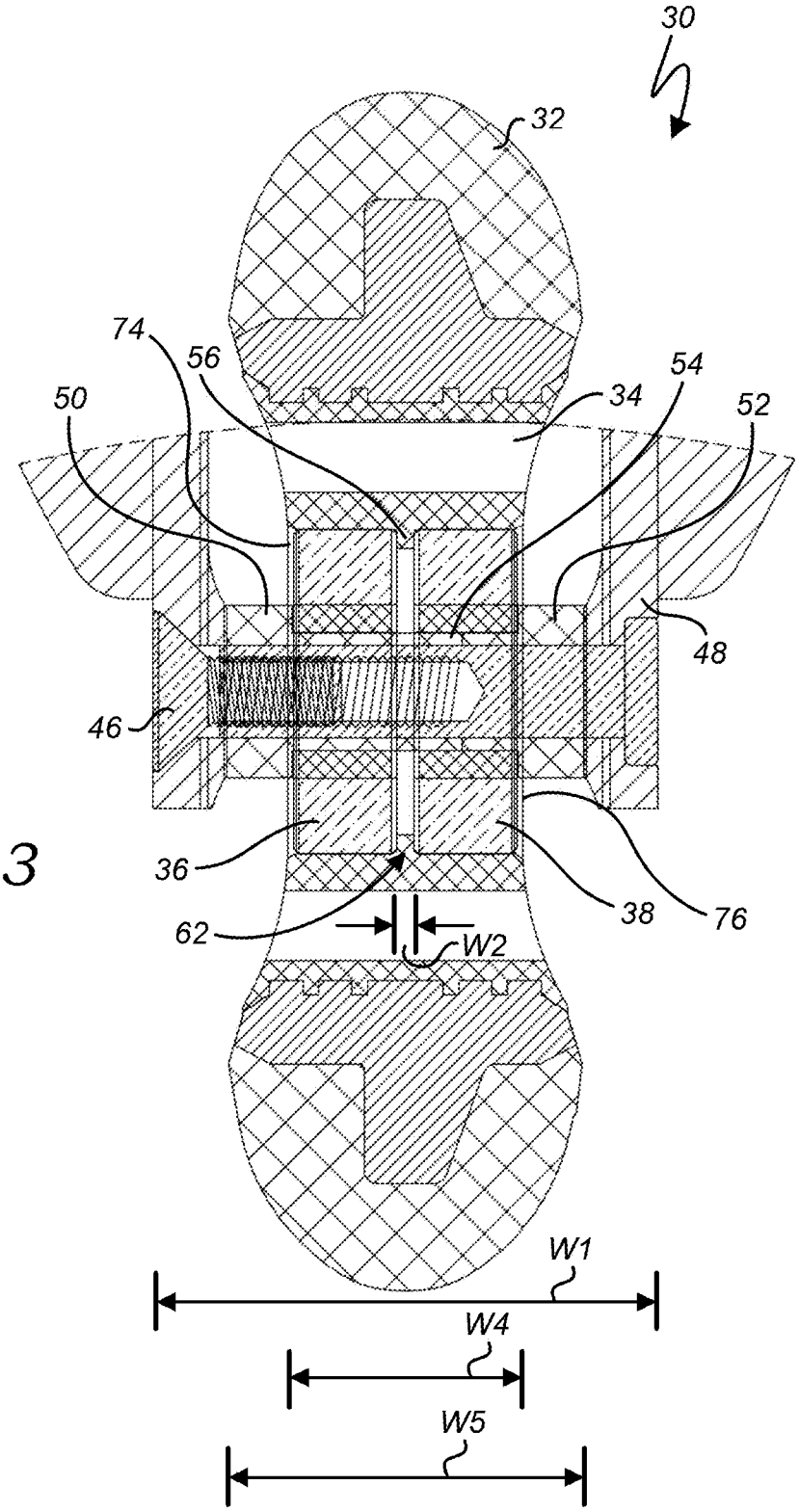
FIG. 3 is a cross-sectional diagram of an exemplary wheel assembly apparatus, in accordance with at least one embodiment.
Figure 4:
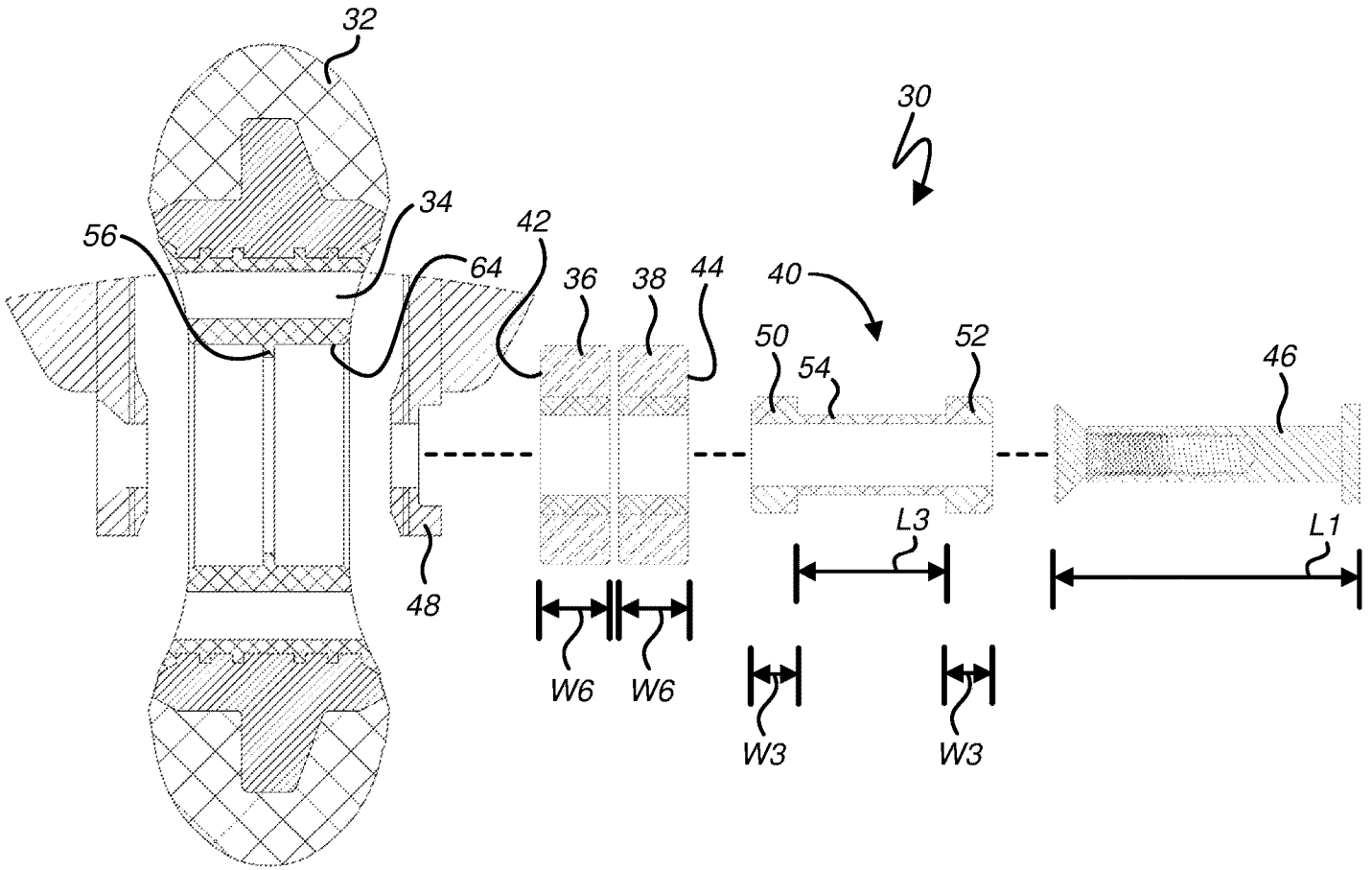
FIG. 4 is an exploded cross-sectional diagram thereof, in accordance with at least one embodiment.

Turning now to FIGS. 3 and 4, there are shown cross-sectional diagrams of an exemplary embodiment of a wheel assembly apparatus 30. At the outset, it should be noted that while the apparatus 30 is shown and described primarily in the context of inline skates, the apparatus 30 should not be read as being so limited. Instead, in further embodiments, the apparatus 30 may be configured for use in virtually any other context where there is a need for a wheel having a pair of laterally opposed bearings. Additionally, it should be noted that while certain embodiments of the apparatus 30 are depicted in the accompanying drawings and described herein for illustrative purposes, in further embodiments, the apparatus 30 (along with each of the components described herein) may take on any other sizes, shapes, dimensions, quantities and/or configurations now known or later developed—dependent at least in part on the context in which the apparatus 30 is to be used—so long as the apparatus 30 is capable of substantially carrying out the functionality described herein.

With continued reference to FIGS. 3 and 4, in at least one embodiment, the apparatus 30 provides a wheel 32, a wheel hub 34 positionable coaxially within the wheel 32, a pair of laterally opposed bearings 36 and 38 positionable coaxially within the wheel hub 34, an at least one outer spacer 40 positionable for contacting an outwardly facing lateral surface 42 and 44 of each of the bearings 36 and 38, and an axle 46 configured for extending coaxially through each of the at least one outer spacer 40, the bearings 36 and 38, the wheel hub 34 and the wheel 32, thereby enabling the wheel 32 to rotate about the axle 46. In at least one embodiment, where the apparatus 30 is configured as an inline skate wheel, the axle 46 has an axle length L1 that is substantially equal to a frame width W1 of the inline skate frame 48 in which the apparatus 30 is installed.

Figure 7:
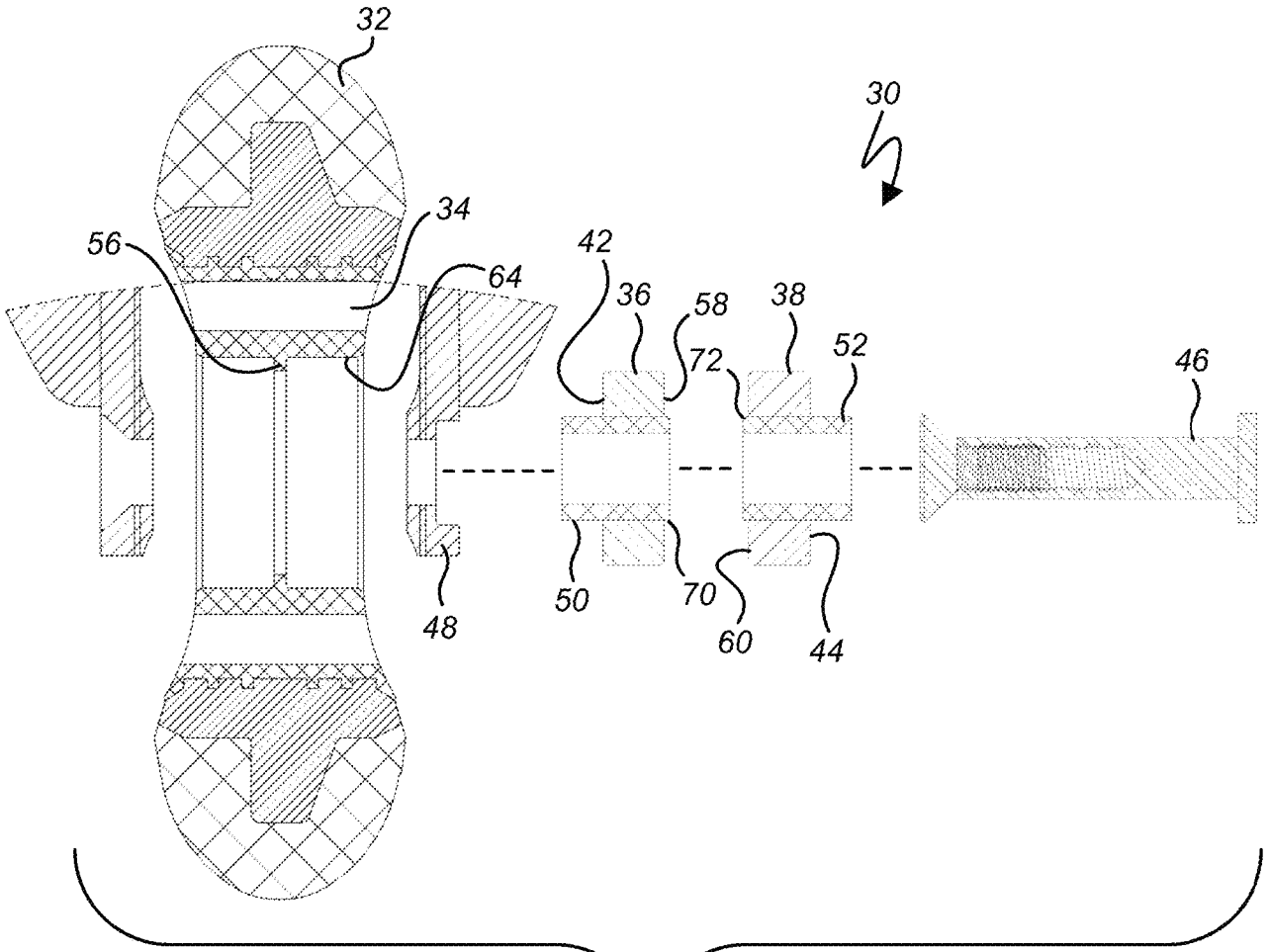
FIG. 7 is an exploded cross-sectional diagram of a still further exemplary wheel assembly apparatus, in accordance with at least one embodiment.

In at least one embodiment, a first outer spacer 50 is positionable for contacting the lateral surface 42 of a first bearing 36, while a second outer spacer 52 is positionable for contacting the lateral surface 44 of a second bearing 38. Accordingly, in at least one embodiment, each of the first outer spacer 50 and second outer spacer 52 is positioned substantially external to the wheel hub 34. Additionally, in at least one embodiment, the first outer spacer 50 and second outer spacer 52 are interconnected by a tubular outer spacer sleeve 54 through which the axle 46 coaxially extends. In at least one such embodiment, the first outer spacer 50, second outer spacer 52 and outer spacer sleeve 54 are constructed as a unitary piece. In at least one alternate embodiment, one or more of the first outer spacer 50, second outer spacer 52 and outer spacer sleeve 54 are separate components. In at least one further alternate embodiment, the outer spacer sleeve 54 may be omitted altogether. In at least one such embodiment, the first outer spacer 50 and second outer spacer 52 are machined into or otherwise integral with the axle 46. In at least one alternate such embodiment, as illustrated in FIG. 7, the first outer spacer 50 is machined into or otherwise integral with the first bearing 36 (extending a distance from the lateral surface 42 of the first bearing 36), while the second outer spacer 52 is machined into or otherwise integral with the second bearing 38 (extending a distance from the lateral surface 44 of the second bearing 38).

Figure 5:
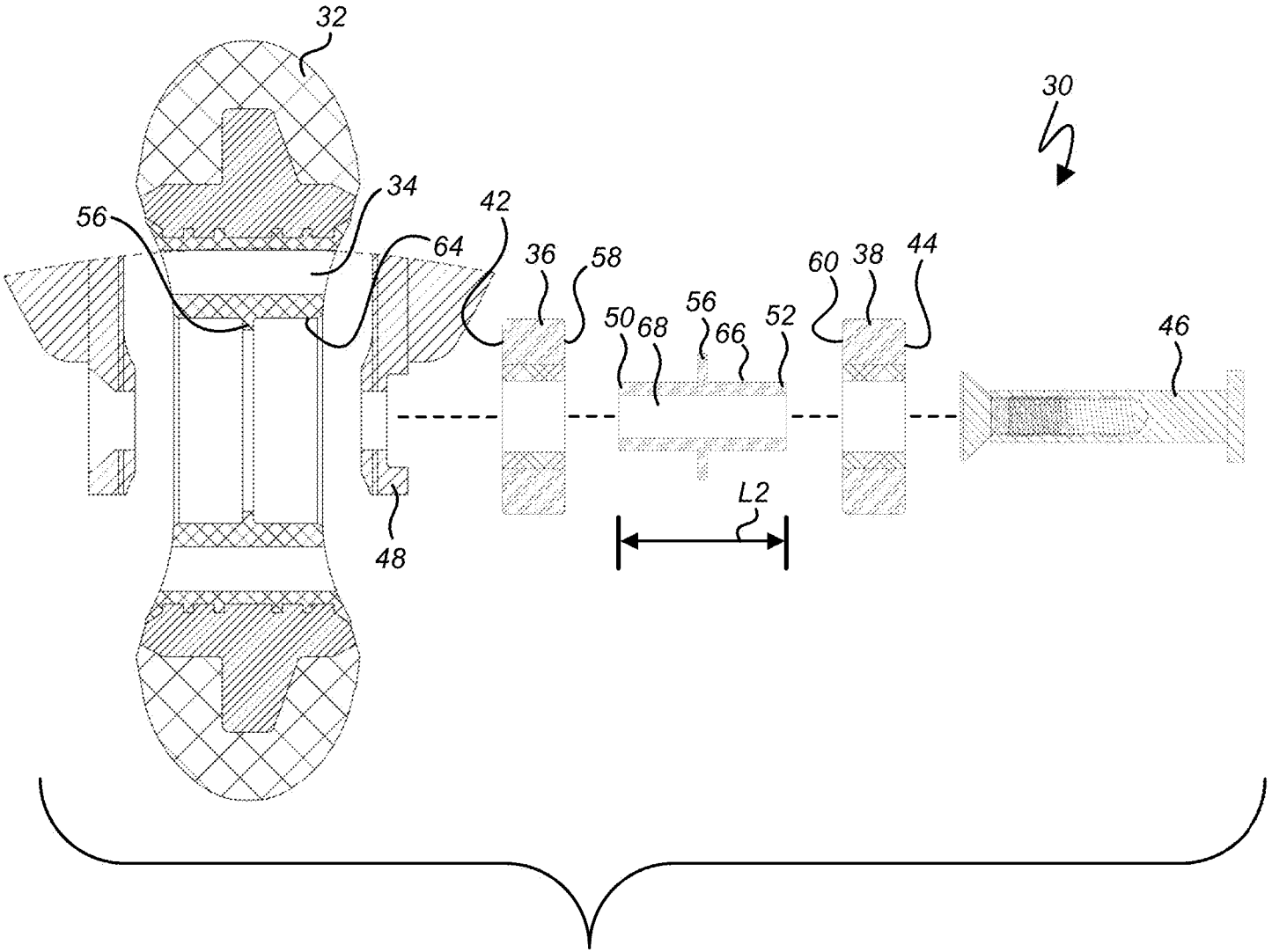
FIG. 5 is an exploded cross-sectional diagram of a further exemplary wheel assembly apparatus, in accordance with at least one embodiment.
Figure 6:
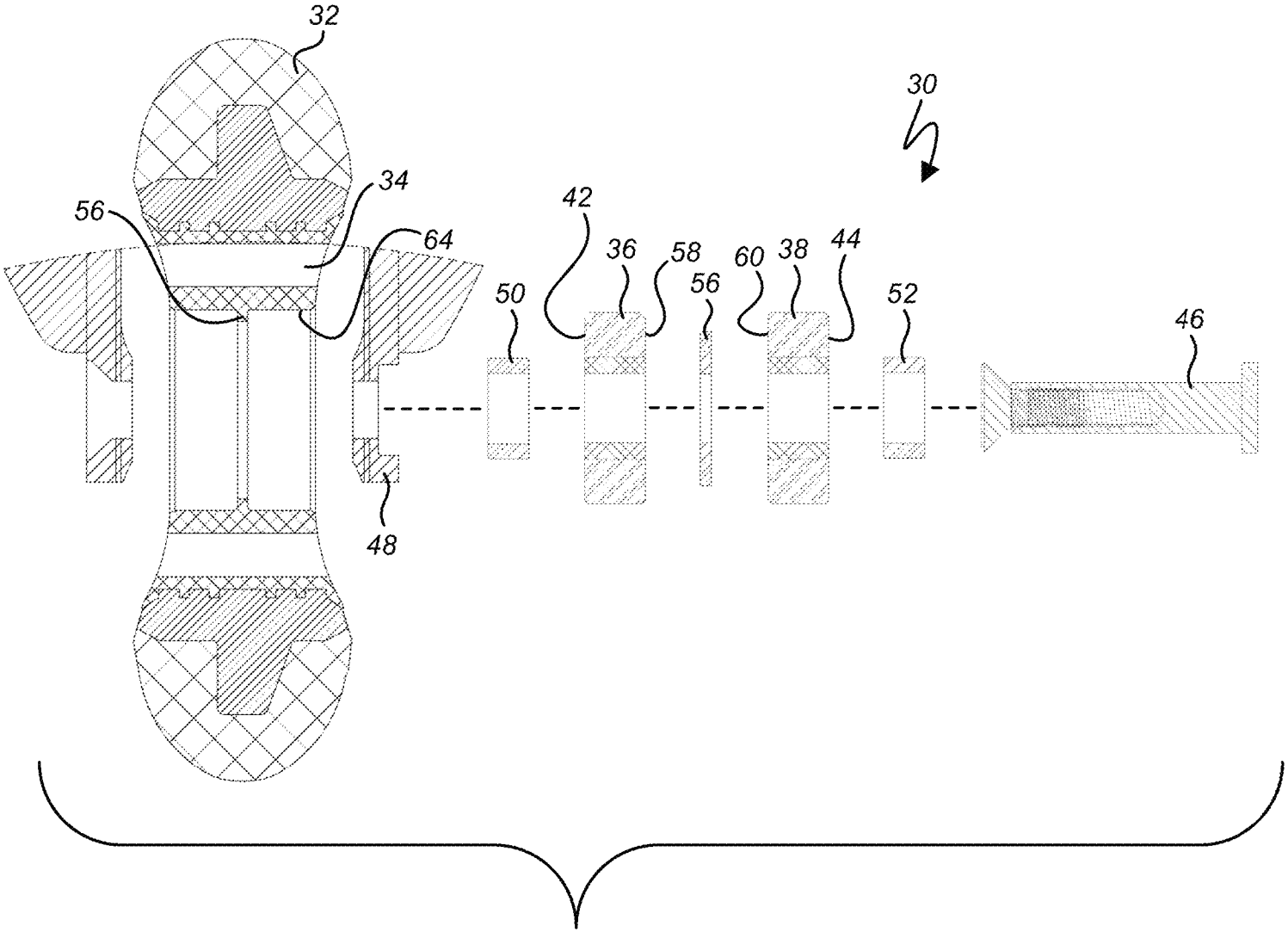
FIG. 6 is an exploded cross-sectional diagram of a still further exemplary wheel assembly apparatus, in accordance with at least one embodiment.
Figure 8:
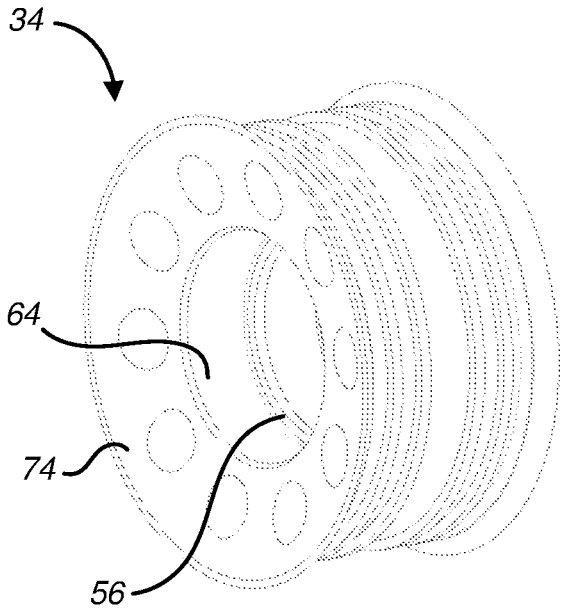
FIG. 8 is a perspective view of an exemplary wheel hub of the apparatus, in accordance with at least one embodiment.

In at least one embodiment, the apparatus 30 further provides an inner spacer 56 positionable coaxially within the wheel hub 34 for contacting an inwardly facing medial surface 58 and 60 of each of the first bearing 36 and second bearing 38, thereby maintaining a small bearing gap 62 between the medial surfaces 58 and 60 of the first bearing 36 and second bearing 38. In at least one embodiment, as illustrated in FIG. 8, the inner spacer 56 is positioned on an annular inner surface 64 of the wheel hub 34 itself. In at least one alternate embodiment, as illustrated in FIGS. 5 and 6, the inner spacer 56 is a separate component. In at least one such embodiment, as illustrated in FIG. 5, the inner spacer 56 is positioned on a circumferential outer surface 66 of a tubular inner spacer sleeve 68 through which the axle 46 coaxially extends. In at least one such embodiment, the inner spacer sleeve 68 coaxially extends a distance through each of the first bearing 36 and second bearing 38 so as to form the first outer spacer 50 and second outer spacer 52. Accordingly, in at least one such embodiment, the inner spacer sleeve 68 has an inner spacer sleeve length L2 that is substantially equal to the sum of the gap width W2, the bearing width W6 of each of the first bearing—36 and second bearing 38, and the spacer width W3 of each of the first outer spacer 50 and second outer spacer 52. In at least one alternate such embodiment, as illustrated in FIG. 7, the inner spacer 56 is comprised of a first inner spacer portion 70 machined into or otherwise integral with the first bearing 36 (extending a distance from the medial surface 58 of the first bearing 36), and a second inner spacer portion 72 machined into or otherwise integral with the second bearing 38 (extending a distance from the medial surface 60 of the second bearing 38). In at least one further alternate embodiment, the inner spacer 56 may be omitted altogether In at least one embodiment, the bearing gap 62 (and, in turn, the inner spacer 56) has a gap width W2 of about 0.01 inches to about 0.05 inches; however, in further embodiments, the gap width W2 may be less than 0.01 inches or greater than 0.05 inches. In at least one embodiment, each of the first outer spacer 50 and second outer spacer 52 has a spacer width W3 of about 0.1 inches to about 0.2 inches; however, in further embodiments, the spacer width W3 may be less than 0.1 inches or greater than 0.2 inches—dependent at least in part on a hub width W4 of the wheel hub 34 and the frame width W1 of the inline skate frame 48 in which the apparatus 30 is installed. In other words, in at least one embodiment, the frame width W1 is substantially equal to the sum of the hub width W4 and the spacer width W3 of each of the first outer spacer 50 and second outer spacer 52, thereby allowing the apparatus 30 to fit within the skate frame 48. In that regard, in at least one embodiment, as best illustrated in FIG. 3, the wheel hub 34 provides laterally opposing first and second sidewalls 74 and 76 that are concave or otherwise inwardly tapered, such that the hub width W4 of the wheel hub 34 is relatively less than a wheel width W5 of the wheel 32, thereby accommodating the spacer width W3 of each of the first outer spacer 50 and second outer spacer 52 so as to enable the apparatus 30 to still fit within the skate frame 48 in place of a traditional wheel 20. In at least one embodiment, the wheel hub 34 has a hub width W4 of about 0.964 inches; however, in further embodiments, the hub width W4 may be less than or greater than 0.964 inches—dependent at least in part on the wheel width W5 of the wheel 32 in which the wheel hub 34 is to be positioned. In at least one embodiment, the wheel 32 has a wheel width W5 of about 24 millimeters; however, in further embodiments, the wheel width W5 may be less than or greater than 24 millimeters—dependent at least in part on the context in which the apparatus 30 is to be used. In at least one embodiment, the outer spacer sleeve 54 has an outer spacer sleeve length L3 that is substantially equal to the sum of the gap width W2 of the bearing gap 62 and a bearing width W6 of each of the first bearing 36 and second bearing 38. In at least one embodiment, each of the first bearing 36 and second bearing 38 has a bearing width W6 of about 0.2 inches to about 0.3 inches; however, in further embodiments, the bearing width W6 may be less than 0.2 inches or greater than 0.3 inches—dependent at least in part on a hub width W4 of the wheel hub 34. In at least one embodiment, the hub width W4 is substantially equal to the sum of the gap width W2 of the bearing gap 62 and the bearing width W6 of each of the first bearing 36 and second bearing 38, thereby allowing each of the first bearing 36 and second bearing 38 to substantially fit within the wheel hub 34. Again, though, as noted above, in further embodiments, the apparatus 30 (along with each of the components described herein) may take on any other sizes, shapes, dimensions, quantities and/or configurations now known or later developed—dependent at least in part on the context in which the apparatus 30 is to be used—so long as the apparatus 30 is capable of substantially carrying out the functionality described herein.

In at least one embodiment, where the apparatus 30 is configured as an inline skate wheel, the wheel 32 is constructed out of polyurethane having a Shore hardness of about 60 A to about 103 A; however, in further embodiments, the wheel may have a Shore hardness of less than 60 A or greater than 103 A—dependent at least in part on the context in which the apparatus 30 is to be used. Similarly, in further embodiments, the wheel 32 may be constructed out of any other materials, now known or later developed, so long as the apparatus 30 is capable of substantially carrying out the functionality described herein.

As a result, in at least one embodiment, where the apparatus 30 is configured as an inline skate wheel, the apparatus 30 is relatively lighter than traditional inline skate wheels. Additionally, given the relatively small bearing gap 62 between the bearings 36 and 38 and the position of the bearings 36 and 38 within the wheel hub 34, the apparatus 30 provides a flex point that is positioned relatively closer to a center of the wheel 32 (as compared to traditional wheels 20), which allows the wheel 32 to flex and have a whip-like feel during use, thereby enhancing wheel stroke and rotational speed of the wheel 32. This, in turn, also causes the wheel 32 itself to wear better, thereby prolonging the life of the wheel 32, even when the wheel 32 is constructed out of a relatively softer material. Furthermore, because the at least one outer spacer 40 is positioned substantially external to the wheel hub 34, assembly of the apparatus 30 is much easier as compared to traditional wheels 20, which typically requires tools to press the prior art bearings 22 and central spacer 26 into the hub 24.

In closing, regarding the exemplary embodiments of the present invention as shown and described herein, it will be appreciated that an improved wheel assembly apparatus is disclosed. Because the principles of the invention may be practiced in a number of configurations beyond those shown and described, it is to be understood that the invention is not in any way limited by the exemplary embodiments, but is generally directed to a wheel assembly apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the terms "about" and "approximately." As used herein, the terms "about" and "approximately" mean that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art, or at least encompassing a range of plus or minus ten percent above and below the value of the stated characteristic, item, quantity, parameter, property, or term.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

It should be understood that any methods disclosed herein, along with the order in which the respective elements of any such method are performed, are purely exemplary. Depending on the implementation, they may be performed in any order or in parallel, unless indicated otherwise in the present disclosure.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor (s) believe that the claimed subject matter is the invention.

What is claimed is:

1. A wheel assembly apparatus comprising:

a wheel;

a wheel hub positionable coaxially within the wheel;

a first bearing and a laterally opposed second bearing each positionable coaxially within the wheel hub, an inwardly facing medial surface of the first bearing laterally spaced apart from an opposing inwardly facing medial surface of the second bearing so as to form a bearing gap therebetween;

a first outer spacer positionable in contact with an outwardly facing lateral surface of the first bearing;

a second outer spacer positionable in contact with an outwardly facing lateral surface of the second bearing; and each of the first outer spacer and second outer spacer positioned substantially external to the wheel hub;

whereby, an axle is capable of extending coaxially through each of the first outer spacer, first bearing, second bearing, second outer spacer, wheel hub and wheel, thereby enabling the wheel to rotate about the axle.

2. The wheel assembly apparatus of claim 1, wherein the first outer spacer and second outer spacer are interconnected by a tubular outer spacer sleeve through which the axle is capable of coaxially extending.

3. The wheel assembly apparatus of claim 1, wherein:

the first outer spacer is integral with the first bearing and extends a distance from the lateral surface of the first bearing; and the second outer spacer is integral with the second bearing and extends a distance from the lateral surface of the second bearing.

4. The wheel assembly apparatus of claim 1, further comprising an inner spacer positionable coaxially within the wheel hub in contact with the medial surface of each of the first bearing and second bearing, thereby maintaining the bearing gap therebetween.

5. The wheel assembly apparatus of claim 4, wherein the inner spacer is positioned on an annular inner surface of the wheel hub.

6. The wheel assembly apparatus of claim 4, wherein the inner spacer is positioned on a circumferential outer surface of a tubular inner spacer sleeve through which the axle is capable of coaxially extending.

7. The wheel assembly apparatus of claim 6, wherein the inner spacer sleeve coaxially extends a distance through each of the first bearing and second bearing so as to form the first outer spacer and second outer spacer.

8. The wheel assembly apparatus of claim 7, wherein the inner spacer sleeve has an inner spacer sleeve length that is substantially equal to the sum of a gap width of the bearing gap, a bearing width of each of the first bearing and second bearing, and a spacer width of each of the first outer spacer and second outer spacer.

9. The wheel assembly apparatus of claim 4, wherein the inner spacer comprises:

a first inner spacer portion integral with the first bearing and extending a distance from the medial surface of the first bearing; and a second inner spacer portion integral with the second bearing and extending a distance from the medial surface of the second bearing.

10. The wheel assembly apparatus of claim 1, wherein the bearing gap has a gap width of about 0.01 inches to about 0.05 inches.

11. The wheel assembly apparatus of claim 1, wherein each of the first outer spacer and second outer spacer has a spacer width of about 0.1 inches to about 0.2 inches.

12. The wheel assembly apparatus of claim 1, wherein the wheel hub provides laterally opposing first and second sidewalls that are concave or otherwise inwardly tapered, such that a hub width of the wheel hub is less than a wheel width of the wheel.

13. The wheel assembly apparatus of claim 1, wherein the wheel hub has a hub width of about 0.964 inches.

14. The wheel assembly apparatus of claim 1, wherein the wheel has a wheel width of about 24 millimeters.

15. The wheel assembly apparatus of claim 2, wherein the outer spacer sleeve has an outer spacer sleeve length that is substantially equal to a sum of the gap width of the bearing gap and a bearing width of each of the first bearing and second bearing.

16. The wheel assembly apparatus of claim 1, wherein each of the first bearing and second bearing has a bearing width of about 0.2 inches to about 0.3 inches.

17. The wheel assembly apparatus of claim 1, wherein the wheel hub has a hub width that is substantially equal to a sum of the gap width of the bearing gap and a bearing width of each of the first bearing and second bearing.

18. A wheel assembly apparatus comprising:

a wheel;

a wheel hub positionable coaxially within the wheel, the wheel hub providing laterally opposing first and second sidewalls that are concave or otherwise inwardly tapered, such that a hub width of the wheel hub is less than a wheel width of the wheel;

a first bearing and a laterally opposed second bearing each positionable coaxially within the wheel hub, an inwardly facing medial surface of the first bearing laterally spaced apart from an opposing inwardly facing medial surface of the second bearing so as to form a bearing gap therebetween;

a first outer spacer positionable in contact with an outwardly facing lateral surface of the first bearing; and a second outer spacer positionable in contact with an outwardly facing lateral surface of the second bearing;

whereby, an axle is capable of extending coaxially through each of the first outer spacer, first bearing, second bearing, second outer spacer, wheel hub and wheel, thereby enabling the wheel to rotate about the axle.

19. A wheel assembly apparatus for use in a wheel hub of a wheel, the apparatus comprising:

a first bearing and a laterally opposed second bearing each positionable coaxially within the wheel hub, an inwardly facing medial surface of the first bearing laterally spaced apart from an opposing inwardly facing medial surface of the second bearing so as to form a bearing gap therebetween;

a first outer spacer positionable in contact with an outwardly facing lateral surface of the first bearing;

a second outer spacer positionable in contact with an outwardly facing lateral surface of the second bearing; and each of the first outer spacer and second outer spacer positioned substantially external to the wheel hub;

whereby, an axle is capable of extending coaxially through each of the first outer spacer, first bearing, second bearing, second outer spacer, wheel hub and wheel, thereby enabling the wheel to rotate about the axle.

* * * * *